US005294479A

United States Patent [19]

Longo

[11] Patent Number: 5,294,479

[45] Date of Patent: Mar. 15, 1994

[54] NON-WOVEN INTERLINING

[75] Inventor: Pietro Longo, West Paterson, N.J.

[73] Assignee: Precision Custom Coatings, Inc., Totowa, N.J.

[21] Appl. No.: 923,613

[22] Filed: Aug. 3, 1992

[51] Int. Cl.[5] ..... B32B 5/02; B32B 5/06; B32B 7/12; D04B 7/12

[52] U.S. Cl. ..... 428/236; 66/169 R; 66/190; 66/191; 66/202; 428/233; 428/253; 428/288; 428/297; 428/343

[58] Field of Search ..... 66/169 R, 200, 192, 66/170, 190, 191, 194, 202; 428/197, 198, 284, 286, 233, 236, 253, 288, 297, 343

[56] References Cited

U.S. PATENT DOCUMENTS

| | | | |
|---|---|---|---|
| 3,395,065 | 7/1968 | Owen, Sr. | 66/192 |
| 3,452,561 | 7/1969 | Stousland et al. | 66/192 |
| 3,611,754 | 10/1971 | Ehrich et al. | 66/192 |
| 3,649,427 | 3/1972 | Hughes | 66/192 |
| 3,816,231 | 6/1974 | Marshall . | |
| 4,183,993 | 1/1980 | Beastead et al. | 428/253 |
| 4,285,216 | 8/1981 | Duhl | 66/192 |
| 4,373,000 | 2/1983 | Knoke et al. . | |
| 4,435,467 | 3/1984 | Rogers . | |
| 4,450,196 | 5/1984 | Kamat . | |
| 4,490,425 | 5/1984 | Knoke et al. . | |
| 4,504,539 | 3/1985 | Petracek et al. . | |
| 4,514,455 | 4/1985 | Hwang . | |
| 4,583,249 | 4/1986 | Kamat et al. . | |
| 4,671,988 | 6/1987 | Dowell et al. | 428/253 |
| 4,696,850 | 9/1987 | Jost et al. . | |
| 4,719,144 | 1/1988 | Kamat . | |
| 4,737,396 | 4/1988 | Kamat . | |
| 4,814,225 | 3/1989 | Kamat . | |
| 4,891,957 | 1/1990 | Strack et al. | 66/192 |
| 4,902,552 | 2/1990 | Kamat . | |
| 5,034,261 | 7/1991 | Loubinoux et al. . | |
| 5,065,559 | 11/1991 | Groshens . | |
| 5,153,056 | 10/1992 | Groshens | 428/253 |
| 5,241,709 | 9/1993 | Kufner et al. | 428/197 |

*Primary Examiner*—James D. Withers
*Attorney, Agent, or Firm*—Peter T. Cobrin; Marvin S. Gittes; Richard I. Samuel

[57] ABSTRACT

An interlining comprising a non-woven substrate with a single or double bar ripple weft stitch knitted therethrough.

5 Claims, 2 Drawing Sheets

NON-WOVEN INTERLINING

FIELD OF THE INVENTION

This invention relates to interlining of the type that is used between the inner lining and outer fabric substrate of a cloth product.

BACKGROUND OF THE INVENTION

In the manufacture of various types of cloth products having an outer fabric substrate and an inner lining, it is a time-honored practice to place an insert, which is normally referred to as an interlining, between the outer fabric substrate and the inner lining. This can be found in garments such as suits, shirts, blouse shoulders, fronts, collars, cuffs, etc.

Normally, the interlining is conventionally adhered or fused to the outer fabric substrate by bonding of a thermoactive adhesive material which can be applied by coating or by printing in spaced deposits or dot patterns, the latter being accomplished by use of a roller. The adhesive is applied to one side of the interlining fabric which is then placed in contact with the outer fabric substrate. The adhesive material in contact with the outer fabric substrate is subjected to heat, as, for example, through ironing or pressing, all of which has the effect of softening the thermoactive adhesive material and causing the interlining fabric to adhere to the outer fabric substrate.

In U.S. Pat. No. 4,737,396, a composite fusible interlining fabric is disclosed. The fabric comprises a non-woven layer and a fibrous layer stitched together. Thus, it can be seen that in this patent the interlining is composed of two different fabrics. Moreover, the stitching runs both lengthwise of the fabric and widthwise thereof.

In U.S. Pat. No. 4,818,227, a fusible interlining fabric is disclosed consisting of a layer of rayon in the warp and filling, this being the woven embodiment, and in a knit embodiment a high wet modulus rayon in a weft-inserted yarn. The stitching does not extend through the interlining.

In U.S. Pat. No. 4,450,196, an interlining fabric is disclosed which is formed of a layer of non-woven fabric, a layer of fibrous material and stitching that extends lengthwise and widthwise of the interlining.

In U.S. Pat. No. 4,719,144, a fusible interlining having a high wet modulus rayon in the warp filling is disclosed.

In U.S. Pat. No. 4,495,661, a composite interlining material is disclosed that includes outside layers of fabric with a sheet of foam sandwiched therebetween. The foam material provides bulk and resiliency to the interlining, while the outside layers of fabric provide smooth and non-abrasive surfaces to the interlining.

In U.S. Pat. No. 4,583,249, a waistband assembly is provided that includes a waistband construction having a woven strip 12 for stiffening the construction and preventing the waist portion of the garment from rolling over. Stiffening strip 12 is stitched to a fabric 18.

Commercially, a popular type of interlining finding widespread acceptance is a weft-inserted knit made from polyester and rayon or rayon components. This prior art interlining material, while extensively used commercially, had drawbacks which diminished its desirability. One prominent drawback that comes to mind with the prior art interlining of the type discussed herein is that there was a relatively high rate of shrinkage, which, of course, was undesirable. Still further, it was difficult to make the interlining soft, which is desirable when the interlining is used in certain types of clothing products where drapability is a requirement. A further drawback with the prior art interlining that is described herein and was comprised of a weft-inserted knit was that the process for making this product was a two-step process wherein one of the steps included knapping. Knapping creates severe environmental problems in that fiber lint is created during the knapping process which has a tendency to fly away. This can create a potential safety hazard and often requires expensive equipment to minimize the potentially deleterious effects of the flyaway lint. For this reason alone, the prior art interlining which was made with a knapping process had severe drawbacks.

It is, of course, desirable that interlining, which is often used as part of clothing, be washable and dry-cleanable, whereas frequently with the prior art the interlining was not washable. Also because interlining is frequently used as part of clothing, it is important that it have a drapable feel.

SUMMARY OF THE INVENTION

It is therefore an object of the present invention to provide an improved interlining.

A further object of the present invention is to provide an improved interlining wherein the deleterious effects of shrinkage are minimized.

Yet another object of the present invention is to provide an improved interlining which can be used in clothing that is both washed and dry-cleaned.

Another object of the present invention is to provide an interlining that can be made without having to knap the product so that the undesirable environmental side-effects of knapping can be eliminated.

A further object of the present invention is to provide in the improved interlining that is soft and drapable such that the interlining is particularly suited for use in clothing.

Another object of the present invention is to provide an improved interlining which has the same general "look" as prior art interlining having a weft-inserted knit so that people who utilize the interlining of the present invention will feel comfortable in that the new interlining has the same general appearance as the interlining previously used.

Briefly, the foregoing and other objects are accomplished by having an interlining composed of a single layer of non-woven fabric. This fabric can be made from polyester and nylon, polyester and differing amounts of nylon and rayon or solely polyester.

In one example, where the fabric is 100% polyester, a short staple polyester fiber having a denier of about 1.5 or 2 is used. A single or double bar ripple weft stitch is knitted through the non-woven polyester substrate with the stitching fiber being polyester and rayon, polyester, rayon and nylon, or solely polyester. A preferred stitch fiber is 100% polyester and has a denier of about 70. The non-woven substrate's properties may be enhanced by hydroentangling or other techniques that are known to those skilled in the art.

An adhesive, which may be a polyamide adhesive or a polyester adhesive, is hot or otherwise applied by a gravure roller to one side of the interlining which is then heat-fastened to the non-woven fabric.

The benefits of using a non-woven substrate with a single or double bar ripple weft stitch are numerous.

Shrinkage is minimized, which, of course, can have enormous economic consequences. As a consequence of minimizing shrinkage, overfeed is minimized.

Still further, by having an interlining in accordance with the present invention, a washable product is obtained in addition to one that can be dry-cleaned. This is a significant advantage when one takes into account that quite frequently interlining is used as a constituent component of a clothing product.

Still further, the interlining of the present invention has the look and feel of prior art interlining so that people who use the new interlining will feel comfortable with the product they are working with.

Finally, and certainly not the least important aspect of the present invention, is the fact that there is no knapping in the process of making the interlining. Thus, the problem of fiber lint flyaway is eliminated, as are the attendant environmental problems associated therewith—e.g., the need for special machinery to remove the flyaway lint and other attendant safety measures.

It can thus be seen that the interlining of the present invention provides significant advantages over the prior art.

Other objects of the invention will become apparent upon a full reading of the specification and claims and a review of the drawings of this application to those possessed of ordinary skill in the art to which this invention pertains.

DESCRIPTION OF THE PREFERRED EMBODIMENTS

Figure 1:
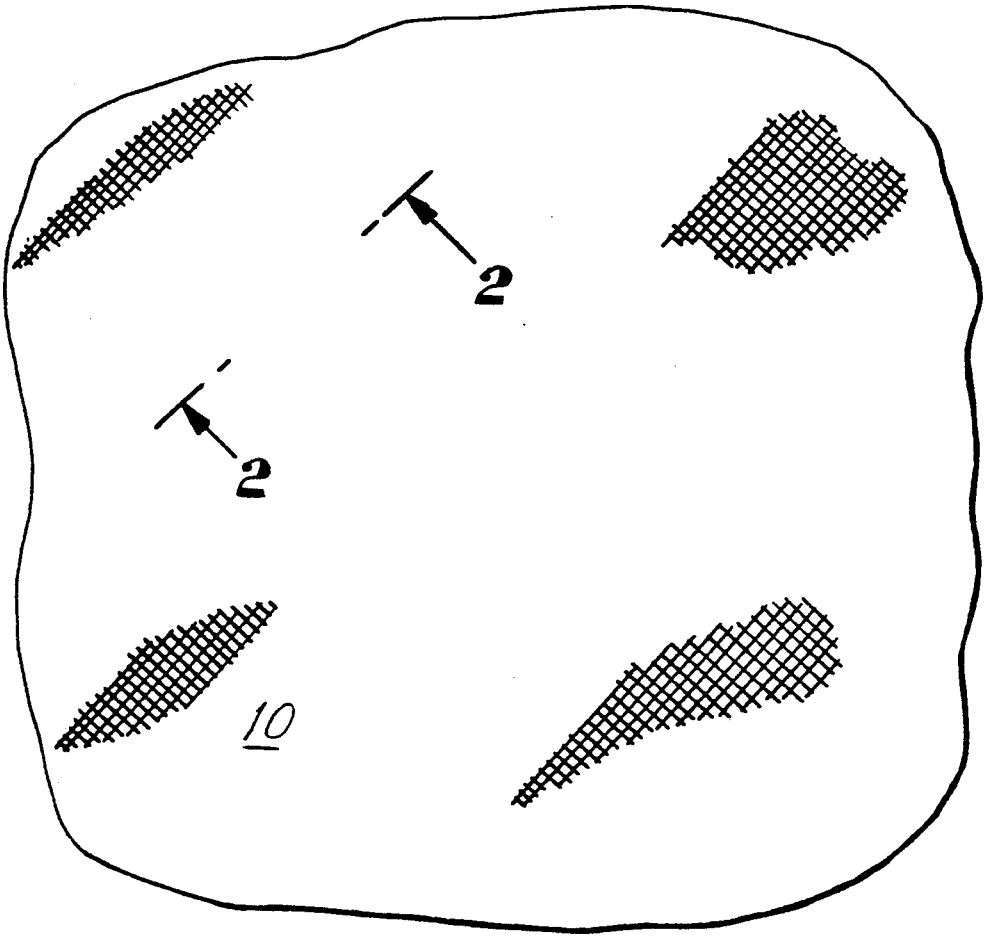
FIG. 1 PRIOR ART
FIG. 1 is a top plan view of prior art interlining.
Figure 2:
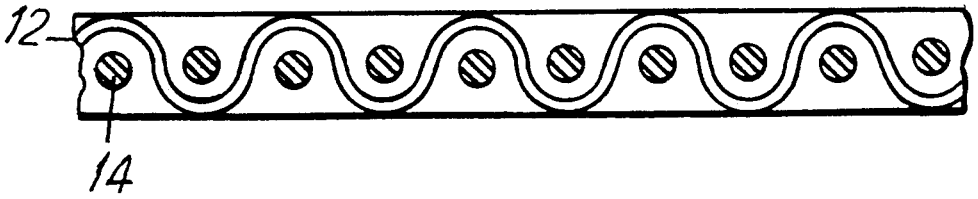
FIG. 2 PRIOR ART
FIG. 2 is a sectional view taken substantially along the line 2—2 of FIG. 1.

In FIG. 1 of the drawings an interlining according to the prior art is shown. The interlining includes a weft-inserted knit substrate 10 that included stitches that are best seen in FIG. 2. These stitches 12 and 14 are perpendicular to each other and extend lengthwise and widthwise of the substrate 10. The interlining just described, while being extensively utilized, had several drawbacks in that it had high shrinkage. Still further, the interlining was not always washable or dry-cleanable. In addition, the interlining just described that was utilized in the prior art was made by a process in which knapping occurred—i.e., fiber lint was created which would fly away during the manufacturing process raising severe environmental and health problems. In order to minimize the potential deleterious effects of knapping, expensive lint removal environmental equipment was necessary which, of course, added to the drawbacks of the prior art interlining.

Figure 3:
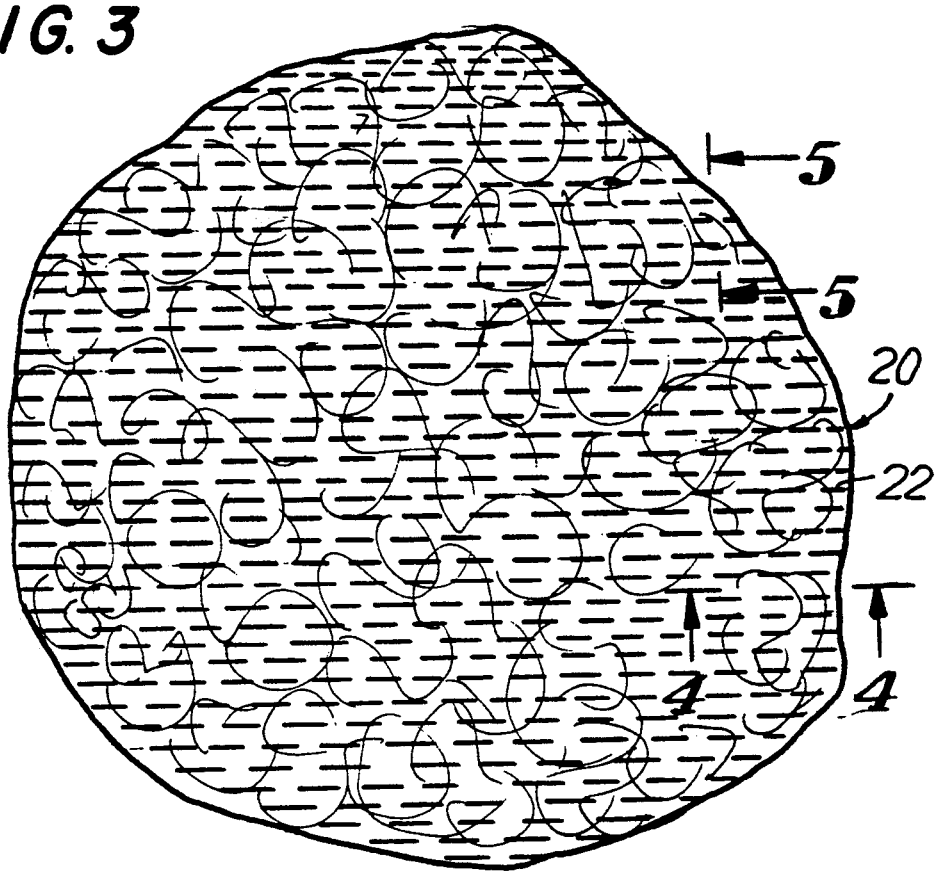
FIG. 3 is a top plan view of interlining according to the present invention.
Figure 4:
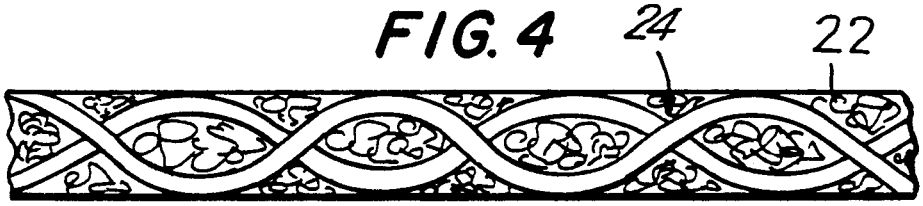
FIG. 4 is a view taken substantially along the line 4—4 of FIG. 3.
Figure 5:
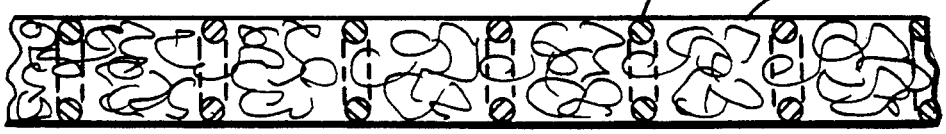
FIG. 5 is a view taken substantially along the line 5—5 of FIG. 3.

In FIGS. 3, 4 and 5, interlining 20 according to the present invention is illustrated. Fabric 22 is a non-woven substrate that can consist of polyester and rayon in varying amounts, such as 90% polyester and 10% rayon, 80% polyester and 20% rayon, and variations thereof, as will be apparent to those or ordinary skill in the art. Alternatively, the non-woven fabric substrate can consist of polyester and combinations of rayon and nylon with the amounts of rayon and nylon being varied according to the requirements of use. As a further alternative, the non-woven substrate may consist of polyester and nylon in varying amounts or, alternatively, may consist solely of polyester.

Knitted through the non-woven substrate is single or double bar ripple weft stitching 24 which may be made from a polyester fiber, a fiber made from polyester and rayon, a fiber made from polyester, rayon and nylon, or a fiber made from polyester and nylon.

Excellent results have been obtained with the stitch fiber being 100% polyester and having a denier of about 75, with the non-woven fabric substrate being 100% polyester and being made of short staple fiber in the range of 1.5 to 2 denier.

Adhesive, which may preferably be a polyamide adhesive or a polyester adhesive, is applied to the interlining by conventional techniques such as a gravure roller or other type of roller in a dot or blank pattern. The adhesive is heated so that the same will adhere the interlining to the outer fabric substrate.

The outer fabric substrate may have its properties enhanced by conventional techniques such as hydroentangling.

There are many significant advantages obtained with an interlining according to the present invention. The interlining, when used in clothing, provides a significant advantage in that the clothing can be washed and/or dry-cleaned in most instances. Shrinkage is minimized so that the need for overfeed is greatly reduced. This has obvious commercial advantages.

Still further, the interlining according to the present invention has the look and feel of prior art interlining without many of the drawbacks associated therewith. Accordingly, those who use interlining will comfortable with using the interlining of the present invention since it will look and feel like prior art interlining, only having significant advantages of the kind discussed herein.

A further advantage of the interlining of the present invention is that during the process of manufacturing the interlining, the need for knapping is eliminated and hence there is no flyaway lint of the kind associated with knapping. This eliminates the need for equipment to remove this flyaway lint which was required during the manufacturing of prior art interlinings. This in and of itself is a significant commercial advantage since the lint removal equipment and environmental procedures attendant thereto can be quite expensive.

A still further advantage of the present invention is that the interlining thereof is soft and has good drapability so it is particularly adapted for use in clothing.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. An interlining fabric comprising a non-woven fabric and a single or double bar ripple weft stitch knitted therethrough wherein said non-woven fabric is selected from the group consisting of 100% polyester; polyester and rayon; polyester and rayon and nylon; and polyester and nylon fabrics.

2. An interlining fabric according to claim 1 wherein the stitch is made from a fiber selected from the group consisting of polyester; polyester and rayon; polyester and nylon; and polyester and rayon and nylon fibers.

3. An interlining fabric according to claim 2 wherein said stitch has a denier of about 70 and is made from 100% polyester.

4. An interlining according to claim 3 wherein an adhesive is located on one side of the interlining and selected from the group consisting of a polyamide adhesive and a polyester adhesive.

5. An interlining fabric according to claim 3 wherein the non-woven fabric is made from 100% polyester short staple fiber having a denier in the range of about 1.5 to 2 denier.

* * * * *